US011715403B2

(12) United States Patent
Zhang et al.

(10) Patent No.: US 11,715,403 B2
(45) Date of Patent: Aug. 1, 2023

(54) LEVEL CONVERSION CIRCUIT, AND DISPLAY PANEL

(71) Applicants: Beijing BOE Display Technology Co., Ltd., Beijing (CN); BOE Technology Group Co., Ltd., Beijing (CN)

(72) Inventors: Yinlong Zhang, Beijing (CN); Shulin Yao, Beijing (CN); Zhihua Sun, Beijing (CN); Qi Li, Beijing (CN); Wenpeng Ma, Beijing (CN); Pengfei Hu, Beijing (CN)

(73) Assignees: BEIJING BOE DISPLAY TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/908,561

(22) PCT Filed: Jun. 16, 2021

(86) PCT No.: PCT/CN2021/100460
§ 371 (c)(1),
(2) Date: Sep. 1, 2022

(87) PCT Pub. No.: WO2021/254406
PCT Pub. Date: Dec. 23, 2021

(65) Prior Publication Data

US 2023/0086073 A1 Mar. 23, 2023

(30) Foreign Application Priority Data

Jun. 18, 2020 (CN) ..... 202010557500.0

(51) Int. Cl.
*G09G 3/20* (2006.01)

(52) U.S. Cl.
CPC ..... *G09G 3/20* (2013.01); *G09G 3/2096* (2013.01); *G09G 2310/0286* (2013.01);
(Continued)

(58) Field of Classification Search
CPC ..... G09G 3/20; G09G 2310/0286; G09G 2310/0289; G09G 2310/0291; G09G 2310/08; G09G 2330/021; G09G 3/2096
See application file for complete search history.

(56) References Cited

U.S. PATENT DOCUMENTS 9,583,059 B2 2/2017 Zheng et al.
10,916,214 B2 2/2021 Huang
(Continued)

FOREIGN PATENT DOCUMENTS

CN 101950520 A 1/2011
CN 101996555 A 3/2011
(Continued)

OTHER PUBLICATIONS

International Search Report and Written Opinion dated Aug. 26, 2021, in corresponding PCT/CN2021/100460, 10 pages.
(Continued)

*Primary Examiner* — Gerald Johnson
(74) *Attorney, Agent, or Firm* — Xsensus LLP

(57) ABSTRACT

A level conversion circuit and a display panel are provided. The level conversion circuit includes a signal generation circuit configured to output driving signals through a plurality of signal output terminals, a first operational amplification circuit configured to level-convert a voltage of an input terminal and output the voltage through an output terminal, and signal output terminals of the signal generation circuit are in one-to-one correspondence with input terminals of the first operational amplification circuit; a plurality of switching circuits connected between the signal output
(Continued)

terminal and the input terminal, connected to a control signal terminal, and configured to communicate the signal output terminal with the input terminal in response to a signal of the control signal terminal. At least part of the switching circuits are connected to different control signal terminals.

20 Claims, 3 Drawing Sheets

(52) U.S. Cl.
CPC ..... *G09G 2310/0289* (2013.01); *G09G 2310/0291* (2013.01); *G09G 2310/08* (2013.01); *G09G 2330/021* (2013.01)

(56) References Cited

U.S. PATENT DOCUMENTS

| | | | | |
|---|---|---|---|---|
| 2007/0229438 | A1 | 10/2007 | Shin | |
| 2013/0082996 | A1 | 4/2013 | Kim et al. | |
| 2014/0015818 | A1 | 1/2014 | Cho | |
| 2016/0012790 | A1 | 1/2016 | Zheng et al. | |
| 2017/0254644 | A1* | 9/2017 | Kanemoto ..... | G01C 19/5726 |
| 2020/0312259 | A1 | 10/2020 | Huang | |

FOREIGN PATENT DOCUMENTS

| | | | |
|---|---|---|---|
| CN | 102982775 | A | 3/2013 |
| CN | 103489425 | A | 1/2014 |
| CN | 102982775 | B | 12/2014 |
| CN | 105609067 | A | 5/2016 |
| CN | 106448580 | A | 2/2017 |
| CN | 106448603 | A | 2/2017 |
| CN | 207781163 | U | 8/2018 |
| CN | 108877638 | A | 11/2018 |
| CN | 109671406 | A | 4/2019 |
| CN | 109785788 | A | 5/2019 |
| CN | 110085188 | A | 8/2019 |
| CN | 110910808 | A | 3/2020 |
| CN | 110910834 | A | 3/2020 |
| CN | 110930924 | A | 3/2020 |
| CN | 111599299 | A | 8/2020 |
| KR | 20040099649 | A | 12/2004 |
| KR | 10-0719666 | B1 | 5/2007 |

OTHER PUBLICATIONS

Chinese Office Action dated Feb. 25, 2023 in corresponding Chinese Patent Application No. 202010557500.0 (with machine-generated English translation), 18 pages.

* cited by examiner

LEVEL CONVERSION CIRCUIT, AND DISPLAY PANEL

CROSS-REFERENCE

The present disclosure is a U.S. National Stage of International Application No. PCT/CN2021/100460, filed on Jun. 16, 2021, which claims priority to Chinese patent application No. 202010557500.0 entitled "LEVEL SHIFTER CIRCUIT, AND DISPLAY PANEL", filed on Jun. 18, 2020, the entire content of which is incorporated herein by reference.

TECHNICAL FIELD

The present disclosure relates to a field of display technology, and more particularly to a level conversion circuit and a display panel.

BACKGROUND

In the display panel, a gate driving circuit needs to input a gate driving signal to a gate line under control of a clock signal. The clock signal is usually generated by the level conversion circuit according to a clock control signal output by a timing controller.

In the related art, a level conversion circuit generally includes a signal generation circuit and an operational amplification circuit. The signal generation circuit is configured to output an original clock signal to a plurality of signal output terminals according to the clock control signal output by the timing controller, and the operational amplification circuit includes a plurality of input terminals and a plurality of output terminals in one-to-one correspondence with the input terminals, and is configured to level-convert a voltage of the input terminal and output the voltage through the output terminal. The signal output terminal of the signal generation circuit may be arranged in one-to-one correspondence with to the input terminal of the operational amplification circuit, and the operational amplification circuit may level-convert the original clock signal to obtain the clock signal.

In the related art, the number of clock signals output by the level conversion circuit is fixed. However, in the display panel, the gate driving circuits with different structures need different numbers of clock signals. Thus, various gate driving circuits need to be configured with level conversion circuits with different structures, thereby increasing a design cost of the level conversion circuit.

It should be noted that the information disclosed in the above BACKGROUND section is only for enhancing the understanding of the background of the present disclosure, and thus may include information that does not constitute the prior art known to those of ordinary skill in the art.

SUMMARY

According to an aspect of the present disclosure, a level conversion circuit is provided and includes a signal generation circuit, a first operational amplification circuit and a plurality of switching circuits. The signal generation circuit is configured to output driving signals through a plurality of signal output terminals respectively. The first operational amplification circuit is configured to level-convert a voltage of an input terminal and output the voltage through an output terminal, and the signal output terminals of the signal generation circuit are arranged in one-to-one correspondence with input terminals of the first operational amplification circuit. The switching circuit is connected between the signal output terminal of the signal generation circuit and the input terminal of the first operational amplification circuit that are in one-to-one correspondence, connected to a control signal terminal, and configured to communicate the signal output terminal of the signal generation circuit with the input terminal of the first operational amplification circuit in response to a signal of the control signal terminal. At least part of the switching circuits are connected to different control signal terminals.

In an exemplary embodiment of the present disclosure, the level conversion circuit further includes: a register configured to store a control signal set, and a control circuit connected to the register and the control signal terminals, configured to input corresponding control signals to the plurality of control signal terminals according to the control signal set.

In an exemplary embodiment of the present disclosure, the level conversion circuit is applied to a display panel, the display panel further includes a timing controller shared by the control signal generation circuit.

In an exemplary embodiment of the present disclosure, the switching circuit is configured to communicate the signal output terminal of the signal generation circuit with the input terminal of the first operational amplification circuit in response to a high-level signal; the control signal set includes a first control signal and a second control signal, the plurality of control signal terminals include a first control signal terminal, a second control signal terminal, a third control signal terminal, and a fourth control signal terminal, the control circuit includes: a first AND gate provided with a first input terminal and a second input terminal connected to a high-level signal terminal and an output terminal connected to the first control signal terminal; an OR gate provided with a first input terminal receiving the first control signal, a second output terminal receiving the second control signal, and an output terminal connected to the second control signal terminal; a second AND gate provided with a first input terminal receiving the first control signal, a second input terminal receiving the first control signal, and an output terminal connected to the third control signal terminal; a third AND gate provided with a first input terminal receiving the first control signal, a second input terminal receiving the second control signal, and an output terminal connected to the fourth control signal terminal.

In an exemplary embodiment of the present disclosure, at least one of the control signal terminals is connected to the plurality of switching circuits.

In an exemplary embodiment of the present disclosure, the plurality of switching circuits includes a first switching circuit, a second switching circuit, a third switching circuit, a fourth switching circuit, a fifth switching circuit, a sixth switching circuit, a seventh switching circuit, an eighth switching circuit, a ninth switching circuit, and a tenth switching circuit; the first control signal terminal is connected to the first switching circuit, the second switching circuit, the third switching circuit, and the fourth switching circuit; the second control signal terminal is connected to the fifth switching circuit and the sixth switching circuit; the third control signal terminal is connected to the seventh switching circuit and the eighth switching circuit; and the fourth control signal terminal is connected to the ninth switching circuit and the tenth switching circuit.

In an exemplary embodiment of the present disclosure, the switching circuit includes: a switching transistor, provided with a first terminal connected to the input terminal of the first operational amplification circuit, a second terminal connected to the signal output terminal of the signal generation circuit, and a control terminal connected to the control signal terminal.

In an exemplary embodiment of the present disclosure, the level conversion circuit is applied to a display panel, the display panel includes a gate driving circuit, and the output terminal of the first operational amplification circuit is configured to provide a clock signal to the gate driving circuit.

In an exemplary embodiment of the present disclosure, the display panel further includes a timing controller, and the signal generation circuit is configured to generate the driving signals under control of the timing controller, wherein the driving signal includes an original clock signal, and the first operational amplification circuit is configured to form the clock signal by level-converting the original clock signal.

In an exemplary embodiment of the present disclosure, the register is connected to a control signal generation circuit for configuring the control signal set to the register.

In an exemplary embodiment of the present disclosure, the control signal set includes a plurality of control signals, the register includes a plurality of triggers, and each of the triggers stores one of the control signals.

In an exemplary embodiment of the present disclosure, the control signal generation circuit and the register are connected through an I2C bus.

In an exemplary embodiment of the present disclosure, the level conversion circuit is applied to a display panel, and the display panel further includes a power management circuit including a first low-level output terminal and a high-level output terminal, power supply terminals of the first operational amplification circuit are connected to the first low-level output terminal and the high-level output terminal, respectively, and the first operational amplification circuit further includes a third low-level output terminal.

In an exemplary embodiment of the present disclosure, the power management circuit further includes a second low-level output terminal, and the level conversion circuit further includes: a second operational amplification circuit including a fourth low-level output terminal, wherein power supply terminals of the second operational amplification circuit are connected to the second low-level output terminal and the high-level output terminal, respectively.

According to another aspect of the present disclosure, a display panel is provided and includes the above level conversion circuit.

It should be understood that the preceding general description and the following detailed description are exemplary and explanatory only and are not restrictive of the disclosure.

BRIEF DESCRIPTION OF THE DRAWINGS

The accompanying drawings here are incorporated in the specification and constitute a part of this specification, show embodiments in accordance with the present disclosure and serve to explain the principles of the present disclosure together with the specification. Obviously, the drawings in the following description are only some embodiments of the present disclosure, and for those ordinary skills in the art, other drawings can also be obtained from these drawings without creative efforts.

DETAILED DESCRIPTION

Figure 1:
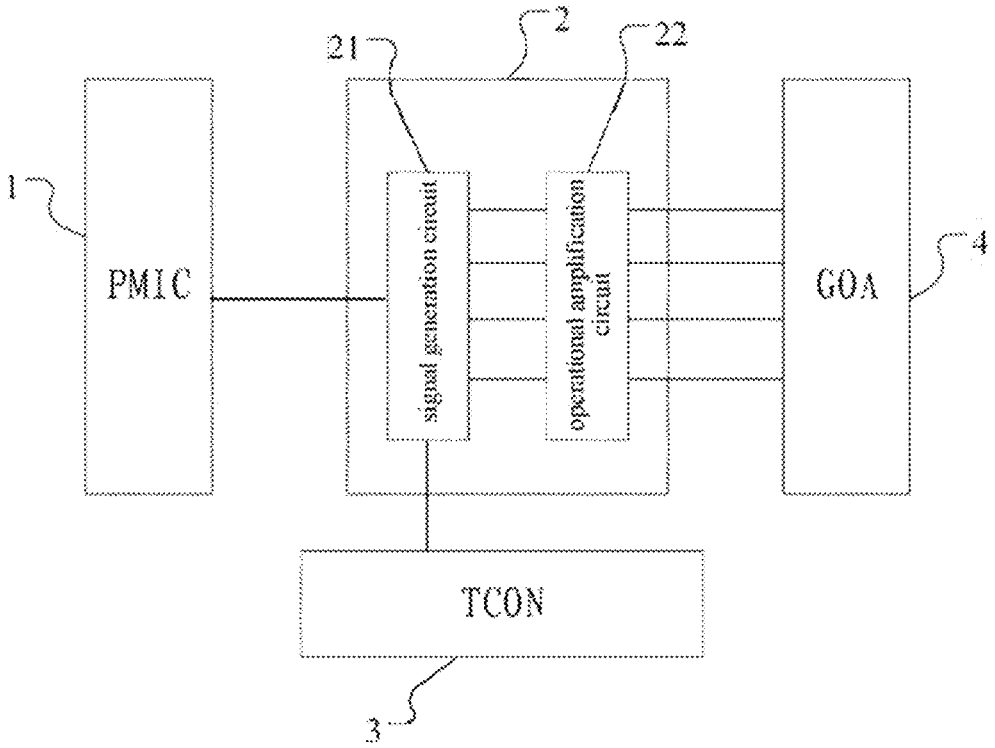
FIG. 1 is a partial structural diagram of a display panel in the related art.

Example embodiments will now be described more fully with reference to the accompanying drawings. However, the example embodiments can be implemented in various forms and should not be construed as limited to the embodiments set forth herein; rather, these embodiments are provided so that the disclosure will be more thorough and complete, and will fully convey the concept of the example embodiments to those skilled in the art. The same reference numerals in the drawings denote the same or similar structures, and thus their detailed descriptions will be omitted.

Although relative terms such as "up" and "down" are used in this specification to describe the relative relationship between one component illustrated in the drawings and another component, these terms are used in this specification for convenience only, for example, according to the illustrative direction depicted in the drawings. It can be understood that if the device illustrated in the drawings is inversed and turned upside down, the component described "above" would become the component "below". Other relative terms, such as "high", "low", "top", "bottom", "left", "right", and the like, also have similar meanings. When a structure is "on" other structure(s), it may mean that the structure is integrally formed on the other structure(s), or that the structure is "directly" arranged on the other structure(s), or that the structure is "indirectly" arranged on other structure (s) through another structure.

The terms "a", "an" and "the" are used to indicate the presence of one or more elements/components/etc.; and the terms "comprising" and "including" are used to mean open-ended inclusion and mean that there may be other elements/components/etc. besides the listed elements/components/etc.

FIG. 1 is a partial structural diagram of a display panel in the related art. The display panel includes a power management circuit 1, a timing controller 3, a level conversion circuit 2, and a gate driving circuit 4. The gate driving circuit 4 needs to input a gate driving signal to a gate line under control of a clock signal. The level conversion circuit 2 is configured to supply the clock signal to the gate driving circuit 4 according to a clock control signal provided by the timing controller 3 under the driving of a power source supplied from the power management circuit 1. As shown in FIG. 1, the level conversion circuit 2 includes a signal generation circuit 21 and an operational amplification circuit 22. The signal generation circuit 21 is configured to output an original clock signals to a plurality of signal output terminals according to a timing signal output by the timing controller 3. The operational amplification circuit 22 includes a plurality of input terminals and a plurality of output terminals in one-to-one correspondence with the input terminals, and is configured to level-convert a voltage of the input terminal and output the voltage through the output terminal. The signal output terminal of the signal generation circuit 21 may be arranged in one-to-one correspondence with to the input terminal of the operational amplification circuit 22, and the operational amplification circuit may level convert the original clock signal to output the clock signal to the gate driving circuit 4. In the related art, the number of clock signals output by the level conversion circuit 2 is the number of clock signals output by the operational amplification circuit 22. In the related art, the number of clock signals output by the level conversion circuit 2 is a fixed quantity. However, in the display panel, the gate driving circuits 4 with different structures need different numbers of clock signals. Thus, the gate driving circuits with different structures need to be configured with level conversion circuits with different structures, which leads to a high design cost of the level conversion circuits in the related art.

Figure 2:
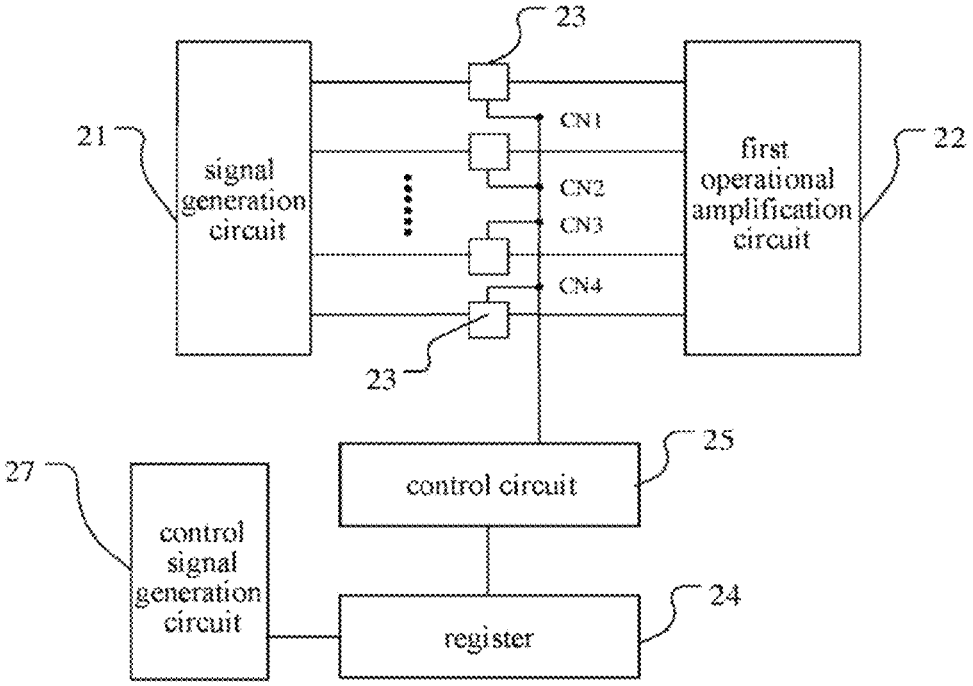
FIG. 2 is a schematic structural diagram of an exemplary embodiment of a level conversion circuit of the present disclosure.

Based on this, the present exemplary embodiment provides a level conversion circuit. As shown in FIG. 2, which is a schematic structural diagram of an exemplary embodiment of a level conversion circuit of the present disclosure. The level conversion circuit may include a signal generation circuit 21, a first operational amplification circuit 22, and a plurality of switching circuits 23. The signal generation circuit 21 may include a plurality of signal output terminals, and the signal generation circuit 21 is configured to output an original clock signal through the plurality of signal output terminals. The first operational amplification circuit 22 may include a plurality of input terminals and a plurality of output terminals in one-to-one correspondence with the plurality of input terminals, so as to level-convert a voltage of an input terminal and output the voltage through an output terminal corresponding to the input terminal, and the signal output terminals of the signal generation circuit 21 are arranged in one-to-one correspondence with the input terminals of the first operational amplification circuit 22, such that the first operational amplification circuit 22 may level convert the original clock signal output from the signal generation circuit 21 to generate a clock signal. The switching circuit 23 may be connected between the signal output terminal of the signal generation circuit 21 and the input terminal of the first operational amplification circuit 22 that are in one-to-one correspondence, and may be connected to a control signal terminal. The switching circuit 23 may be configured to communicate the signal output terminal of the signal generation circuit 21 with the input terminal of the first operational amplification circuit 22 in response to a signal of the control signal terminal. At least part of the switching circuits may be connected to different control signal terminals. For example, as shown in FIG. 2, there are different switching circuits connected to the control signal terminals CN1, CN 2, CN3, and CN4 respectively.

The level conversion circuit may control the number of communication channels between the first operational amplification circuit and the signal generation circuit by controlling the on/off of the switching circuit, i.e., by controlling the number of output terminals of the clock signal output by the first operational amplification circuit, such that the level conversion circuit may be fitted with different gate driving circuits.

As shown in FIG. 2, the level conversion circuit further includes a register 24 and a control circuit 25. The register 24 may be configured to store a control signal set. The control circuit 25 may be connected to the register 24 and the plurality of control signal terminals, and the control circuit 25 may be configured to input corresponding control signals to the plurality of control signal terminals according to the control signal set to control the on or off of different switching circuits.

It should be understood that the level conversion circuit may be applied not only to a display panel, but also to other electronic devices. The level conversion circuit may output not only a clock signal but also other driving signals. Accordingly, the level conversion circuit may control the number of other driving signal outputs.

In this exemplary embodiment, the register 24 may be connected to a control signal generation circuit 27, and the control signal generation circuit 27 may be configured to configure the control signal set to the register. The control signal generation circuit may be a circuit other than the level conversion circuit. For example, the control signal generation circuit may share a timing controller in the display panel, and the display panel may configure the control signal set to the register through the timing controller every time the display panel is powered on. This arrangement may avoid providing an additional storage space and a processing unit in the level conversion circuit, thereby reducing the cost of the level conversion circuit. The control signal generation circuit may be connected with the register through an I2C bus.

The following exemplary embodiment provides an embodiment in which a control circuit controls different switching circuits to be on/off according to a control signal set. In this exemplary embodiment, the switching circuit 23 may be configured to communicate the signal output terminal of the signal generation circuit 21 with the input terminal of the first operational amplification circuit 22 in response to a high-level signal. For example, the switching circuit may include an N-type transistor, a first terminal of the N-type transistor is connected to an input terminal of the first operational amplification circuit, a second terminal is connected to the signal output terminal of the signal generation circuit, and a control terminal is connected to the control signal terminal. The register may be composed of a plurality of triggers, each trigger may store one control signal, and the control signals stored by the plurality of triggers may constitute the control signal set.

Figure 3:
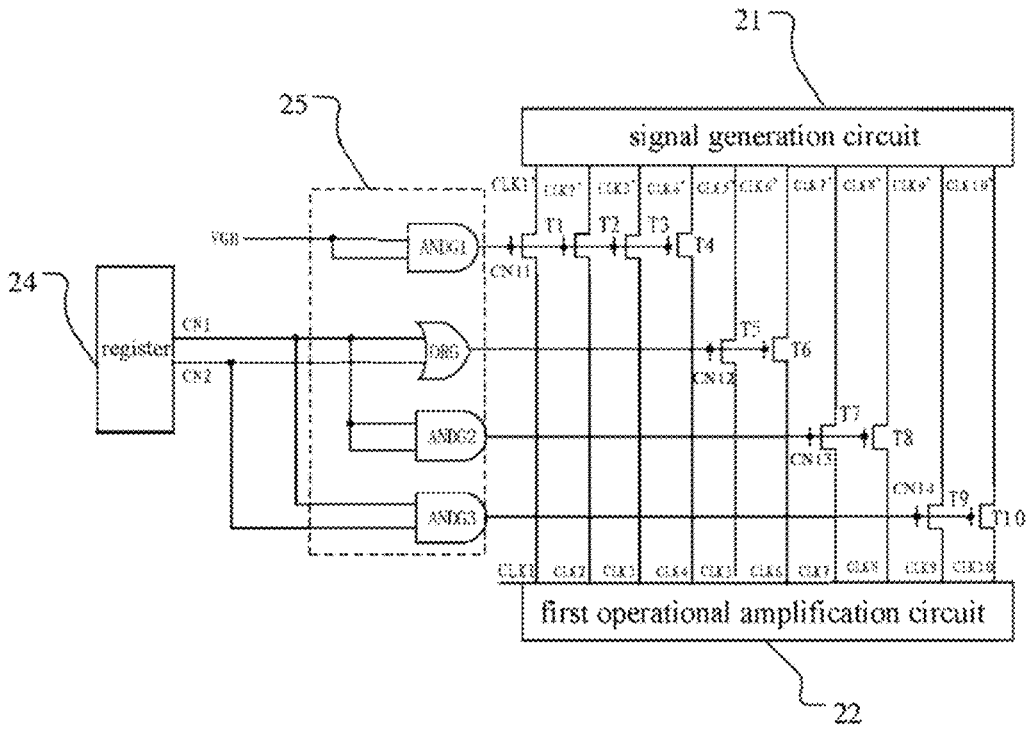
FIG. 3 is a schematic structural diagram of another exemplary embodiment of a level conversion circuit of the present disclosure.

FIG. 3 is a schematic structural diagram of another exemplary embodiment of a level conversion circuit of the present disclosure. In this exemplary embodiment, the register 24 may be a two-bit register, that is, the register includes two triggers, and the output terminals of the two triggers respectively store two control signals: a first control signal CN1 and a second control signal CN2. A plurality of switching circuits 23 may include first to tenth switching circuits, the first switching circuit may include an N-type transistor T1, a second switching circuit may include an N-type transistor T2, a third switching circuit may include an N-type transistor T3, and so on, and a tenth switching circuit may include an N-type transistor T10. The above N-type switching transistors may be provided with first terminals connected to the input terminals of the first operational amplification circuit 22, second terminals connected to the signal output terminals of the signal generation circuit 21, and control terminals connected to the control signal terminal. The signal generation circuit 21 may output ten original clock signals through ten signal output terminals CLK1', CLK2', CLK3' . . . CLK10', respectively. Accordingly, the first operational amplification circuit 22 may include ten input terminals and ten output terminals. The ten input terminals of the first operational amplification circuit 22 are arranged in one-to-one correspondence with the ten output terminals of the signal generation circuit 21. The first operational amplification circuit 22 may include ten input terminals CLK1, CLK2, CLK3 . . . , CLK10. The N-type transistor T1 is connected to the input terminal CLK1 and the output terminal CLK1', the N-type transistor T2 is connected to the input terminal CLK2 and the output terminal CLK2', the N-type transistor T3 is connected to the input terminal CLK3 and the output terminal CLK3', and so on, and N-type transistor T10 is connected to the input terminal CLK10 and the output terminal CLK10'. The ten switching circuits may be connected to four different control signal terminals: a first control signal terminal CN11, a second control signal terminal CN12, a third control signal terminal CN13, and a fourth control signal terminal CN14. For example, gates of the N-type transistors T1-T4 may be connected to the first control signal terminal CN11, and gates of the N-type transistors t5-t6 may be connected to the second control signal terminal CN12, gates of the N-type transistors T7-T8 may be connected to the third control signal terminal CN13, and gates of the N-type transistors T9-T10 may be connected to the fourth control signal terminal CN14. As shown in FIG. 3, the control circuit 25 may include a first AND gate ANDG1, an OR gate ORG, a second AND gate ANDG2, and a third AND gate ANDG3. The first AND gate ANDG1 is provided with a first input terminal and a second input terminal that are connected to a high-level signal terminal VGH, and an output terminal connected to the first control signal terminal CN11. The OR gate ORG is provided with a first input terminal receiving the first control signal CN1, a second output terminal receiving the second control signal CN2, and an output terminal connected to the second control signal terminal CN12. The second AND gate ANDG2 is provided with a first input terminal receiving the first control signal CN1, a second input terminal receiving the first control signal CN1, and an output terminal connected to the third control signal terminal CN13. The third AND gate ANDG3 is provided with a first input terminal receiving the first control signal CN1, a second input terminal receiving the second control signal CN2, and an output terminal connected to the fourth control signal terminal CN14.

As shown in FIG. 3, when the first control signal CN1 and the second control signal CN2 stored in the register are logic 0 and logic 0 respectively, the N-type transistors T1, T2, T3 and T4 are turned on, and the N-type transistors T5, T6, T7, T8, T9 and T10 are turned off. The signal output terminals CLK1', CLK2', CLK3' and CLK4' of the signal generation circuit 21 and the input terminals CLK1, CLK2, CLK3 and CLK4 of the first operational amplification circuit 22 are connected in one-to-one correspondence. Accordingly, the first operational amplification circuit 22 outputs four clock signals. When the first control signal CN1 and the second control signal CN2 stored in the register are logic 0 and logic 1 respectively, the N-type transistors T1, T2, T3, T4, T5 and T6 are turned on, and the N-type transistors T7, T8, T9 and T10 are turned off. The signal output terminals CLK1', CLK2', CLK3', CLK4', CLK5', and CLK6' of the signal generation circuit 21 and the input terminals CLK1, CLK2, CLK3, CLK4, CLK5 and CLK6 of the first operational amplification circuit 22 are connected in one-to-one correspondence. Accordingly, the first operational amplification circuit 22 outputs six clock signals. When the first control signal CN1 and the second control signal CN2 stored in the register are logic 1 and logic 0, respectively, the N-type transistors T1, T2, T3, T4, T5, T6, T7 and T8 are turned on, and the N-type transistors T9 and T10 are turned off. The signal output terminals CLK1', CLK2', CLK3', CLK4', CLK5', CLK6', CLK7' and CLK8' of the signal generation circuit 21 and the input terminals CLK1, CLK2, CLK3, CLK4, CLK5, CLK6, CLK7 and CLK8 of the first operational amplification circuit 22 are connected in one-to-one correspondence. Accordingly, the first operational amplification circuit 22 outputs eight clock signals. When the first control signal CN1 and the second control signal CN2 stored in the register are logic 1 and logic 1 respectively, the N-type transistors T1, T2, T3, T4, T5, T6, T7, T8, T9 and T10 are turned on, and the signal output terminals CLK1', CLK2', CLK3', CLK4', CLK5', CLK6', CLK7', CLK8', CLK9' and CLK 10' of the signal generation circuit 21 and the input terminals CLK1, CLK2, CLK3, CLK4, CLK5, CLK6, CLK7, CLK8, CLK9, and CLK10 of the first operational amplification circuit 22 are connected in one-to-one correspondence. Accordingly, the first operational amplification circuit 22 outputs ten clock signals.

It should be understood that in other exemplary embodiments, there may be other number of the signal output terminals in the signal generation circuit 21, accordingly, the first operational amplification circuit 22 may have the same number of input terminals as the number of the signal output terminals in the signal generation circuit 21, and the number of switching circuits may be the same as the number of signal output terminals in the signal generation circuit 21. The first control signal terminal CN11, the second control signal terminal CN12, the third control signal terminal CN13, and the fourth control signal terminal CN14 may also control other number of switching circuits, respectively. For example, the first control signal terminal CN11 may also control three switching circuits to correspondingly control the on/off of three signal channels, and the second control signal terminal CN12 may also control four switching circuits to correspondingly control the on/off of four signal channels.

Figure 4:
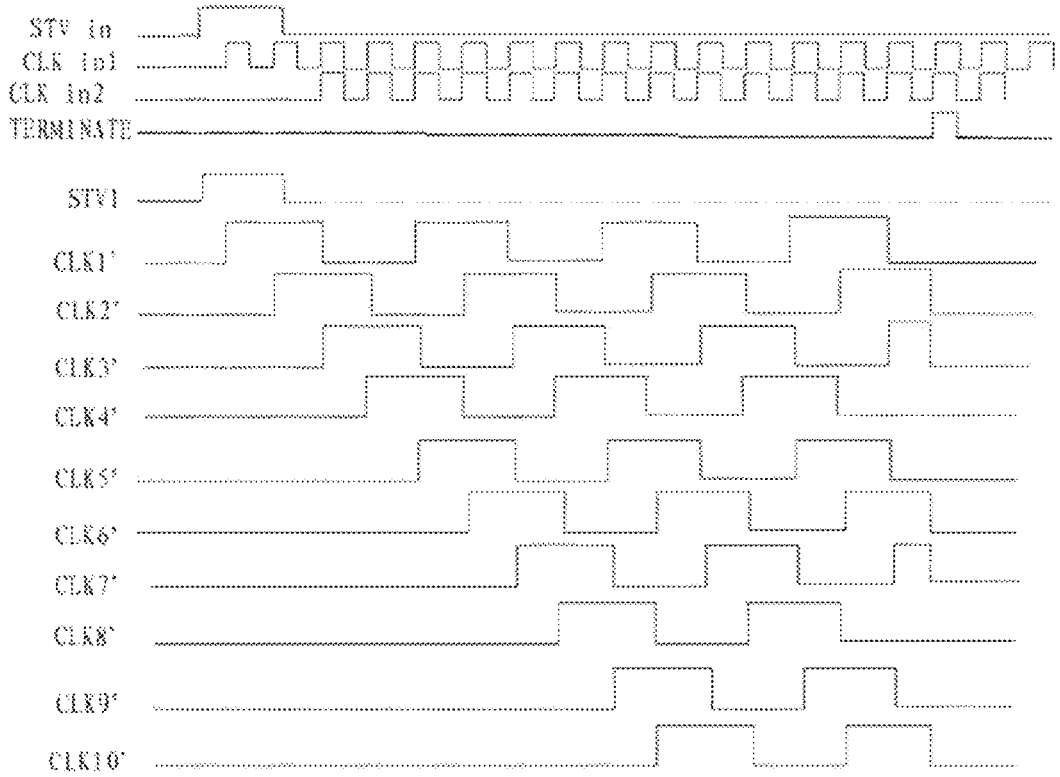
FIG. 4 is a timing diagram of each node of a signal generation circuit in an exemplary embodiment of a level conversion circuit of the present disclosure.

FIG. 4 is a timing diagram of each node of a signal generation circuit in an exemplary embodiment of a level conversion circuit of the present disclosure. In this exemplary embodiment, the signal generation circuit may generate a plurality of original clock signals according to the clock control signal output by the timing controller in a display panel. As shown in FIG. 4, the clock control signal may include clock signals CLK in1 and CLK in2, and an initialization signal STV in. The signal generation circuit may generate the clock signals CLK1', CLK2', CLK3' . . . and CLK10' according to the above clock control signal. In addition, the clock control signal may also include an off signal TERMINATE, which is used to output an effective level between adjacent frames of the display panel to stop the signal output terminals of the signal generation circuit from outputting the clock signals CLK1', CLK2', CLK3' . . . CLK10', thereby avoiding signal interference between frames.

It should be understood that in other exemplary embodiments, the control circuit may have other configurations, and accordingly, the control circuit may control the first operational amplification circuit 22 to output other number of clock signals. The control signal set may also include other number of control signals, the register may include a corresponding number of triggers, and each of the triggers may store one of the control signals.

Figure 5:
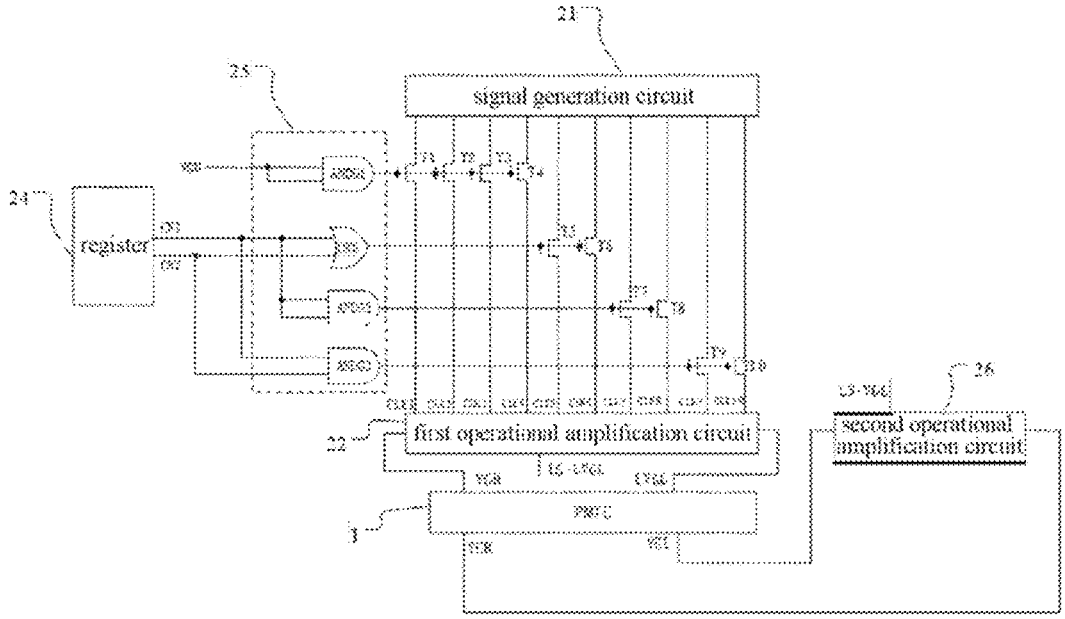
FIG. 5 is a schematic structural diagram of another exemplary embodiment of a level conversion circuit of the present disclosure.

In this exemplary embodiment, as shown in FIG. 5, it is a schematic structural diagram of another exemplary embodiment of a level conversion circuit of the present disclosure. The level conversion circuit may be applied to a display panel, and the display panel may further include a power management circuit 1, which may include a first low-level output terminal LVGL, a second low-level output terminal VGL, and a high-level output terminal VGH. Power supply terminals of the first operational amplification circuit 22 may be connected to the first low-level output terminal LVGL and the high-level output terminal VGH, respectively. The first low-level output terminal LVGL may be used as a low-level signal of a square wave in the clock signal, and the high-level output terminal VGH may be used as a high-level signal of a square wave in the clock signal. The first operational amplification circuit 22 may further include a third low-level output terminal LS-LVGL, a voltage of the third low-level output terminal LS-LVGL may be the same as a voltage of the first low-level output terminal LVGL, and the third low-level output terminal LS-LVGL may control the switching of the transistor during the driving of the gate driving circuit.

In this exemplary embodiment, as shown in FIG. 5, the level conversion circuit may further include a second operational amplification circuit 26, the second operational amplification circuit 26 may include a fourth low-level output terminal LS-VGL, and power supply terminals of the second operational amplification circuit 26 are connected to the second low-level output terminal VGL and the high-level output terminal VGH, respectively. A voltage of the low-level output terminal LS-VGL may be the same as a voltage of the second low-level output terminal VGL, which may be used to discharge the display panel when the display panel is turned off.

In this exemplary embodiment, the signal generation circuit 21 may also generate an original initialization signal under the control of the timing controller, and the original initialization signal may generate an initialization signal acting on the gate driving circuit under the amplification action of the first operational amplification circuit 22.

In this exemplary embodiment, the level conversion circuit may further include other registers which may configure the over-current and over-temperature parameters of the level conversion circuit.

Figure 6:
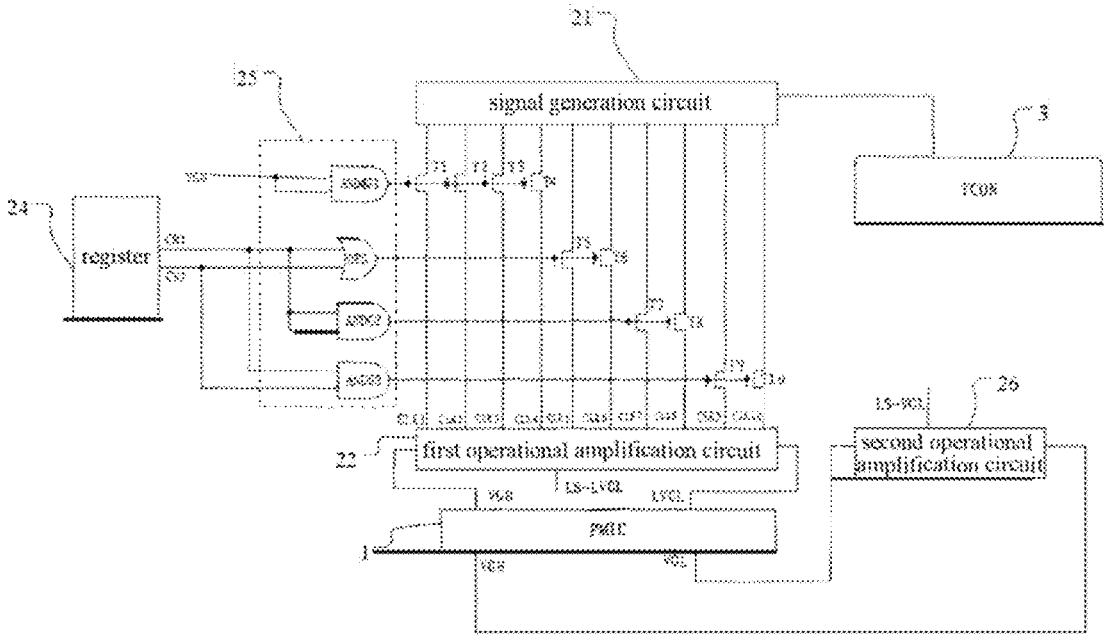
FIG. 6 is a structural diagram of an exemplary embodiment of a display panel of the present disclosure.

An exemplary embodiment of the present disclosure also provides a display panel. As shown in FIG. 6, it is a schematic structural diagram of an exemplary embodiment of a display panel of the present disclosure. The display panel includes the above-mentioned level conversion circuit, the power management circuit 1, and the timing controller 3.

Other embodiments of the present disclosure will be readily conceivable to those skilled in the art upon consideration of the specification and practice of what is disclosed herein. This application is intended to cover any variations, uses, or adaptations of the present disclosure that follow the general principles of the present disclosure and include common knowledge or techniques in the technical field not disclosed by the present disclosure. The specification and examples are to be regarded as exemplary only, with the true scope and spirit of the disclosure being indicated by the claims.

It is to be understood that the present disclosure is not limited to the precise structures described above and illustrated in the accompanying drawings, and that various modifications and changes may be made without departing from the scope thereof. The scope of the present disclosure is limited only by the appended claims.

What is claimed is:

1. A level conversion circuit, comprising:

a signal generation circuit, comprising a plurality of signal output terminals, configured to output driving signals through the plurality of signal output terminals respectively;

a first operational amplification circuit, comprising a plurality of input terminals and a plurality of output terminals in one-to-one correspondence with the input terminals, configured to level-convert a voltage of an input terminal and output the voltage through an output terminal corresponding to the input terminal, and the signal output terminals of the signal generation circuit being arranged in one-to-one correspondence with the input terminals of the first operational amplification circuit;

a plurality of switching circuits, the switching circuit being connected between the signal output terminal of the signal generation circuit and the input terminal of the first operational amplification circuit that are in one-to-one correspondence, connected to a control signal terminal, and configured to communicate the signal output terminal of the signal generation circuit with the input terminal of the first operational amplification circuit in response to a signal of the control signal terminal;

wherein at least part of the switching circuits are connected to different control signal terminals.

2. The level conversion circuit according to claim 1, further comprising:

a register configured to store a control signal set;

a control circuit connected to the register and the control signal terminals, configured to input corresponding control signals to the plurality of control signal terminals according to the control signal set.

3. The level conversion circuit according to claim 2, wherein the register is connected to a control signal generation circuit for configuring the control signal set to the register.

4. The level conversion circuit according to claim 3, wherein the level conversion circuit is applied to a display panel, the display panel further comprises a timing controller shared by the control signal generation circuit.

5. The level conversion circuit according to claim 2, wherein the switching circuit is configured to communicate the signal output terminal of the signal generation circuit with the input terminal of the first operational amplification circuit in response to a high-level signal;

the control signal set comprises a first control signal and a second control signal, the plurality of control signal terminals comprise a first control signal terminal, a second control signal terminal, a third control signal terminal, and a fourth control signal terminal, the control circuit comprises:

a first AND gate provided with a first input terminal and a second input terminal connected to a high-level signal terminal and an output terminal connected to the first control signal terminal;

an OR gate provided with a first input terminal receiving the first control signal, a second output terminal receiving the second control signal, and an output terminal connected to the second control signal terminal;

a second AND gate provided with a first input terminal receiving the first control signal, a second input terminal receiving the first control signal, and an output terminal connected to the third control signal terminal;

a third AND gate provided with a first input terminal receiving the first control signal, a second input terminal receiving the second control signal, and an output terminal connected to the fourth control signal terminal.

6. The level conversion circuit according to claim 1, wherein at least one of the control signal terminals is connected to the plurality of switching circuits.

7. The level conversion circuit according to claim 5, wherein the plurality of switching circuits comprises a first switching circuit, a second switching circuit, a third switching circuit, a fourth switching circuit, a fifth switching circuit, a sixth switching circuit, a seventh switching circuit, an eighth switching circuit, a ninth switching circuit, and a tenth switching circuit;

the first control signal terminal is connected to the first switching circuit, the second switching circuit, the third switching circuit, and the fourth switching circuit;

the second control signal terminal is connected to the fifth switching circuit and the sixth switching circuit; the third control signal terminal is connected to the seventh switching circuit and the eighth switching circuit; and the fourth control signal terminal is connected to the ninth switching circuit and the tenth switching circuit.

8. The level conversion circuit according to claim 1, wherein the switching circuit comprises:

a switching transistor, provided with a first terminal connected to the input terminal of the first operational amplification circuit, a second terminal connected to the signal output terminal of the signal generation circuit, and a control terminal connected to the control signal terminal.

9. The level conversion circuit according to claim 1, wherein the level conversion circuit is applied to a display panel, the display panel comprises a gate driving circuit, and the output terminal of the first operational amplification circuit is configured to provide a clock signal to the gate driving circuit.

10. The level conversion circuit according to claim 9, wherein the display panel further comprises a timing controller, and the signal generation circuit is configured to generate the driving signals under control of the timing controller, wherein the driving signal comprises an original clock signal, and the first operational amplification circuit is configured to form the clock signal by level-converting the original clock signal.

11. The level conversion circuit according to claim 2, wherein the control signal set comprises a plurality of control signals, the register comprises a plurality of triggers, and each of the triggers stores one of the control signals.

12. The level conversion circuit according to claim 3, wherein the control signal generation circuit and the register are connected through an I2C bus.

13. The level conversion circuit according to claim 1, wherein the level conversion circuit is applied to a display panel, and the display panel further comprises a power management circuit comprising a first low-level output terminal and a high-level output terminal, power supply terminals of the first operational amplification circuit are connected to the first low-level output terminal and the high-level output terminal, respectively, and the first operational amplification circuit further comprises a third low-level output terminal.

14. The level conversion circuit according to claim 13, wherein the power management circuit further comprises a second low-level output terminal, and the level conversion circuit further comprises:

a second operational amplification circuit comprising a fourth low-level output terminal, wherein power supply terminals of the second operational amplification circuit are connected to the second low-level output terminal and the high-level output terminal, respectively.

15. A display panel comprising a level conversion circuit, wherein the level conversion circuit comprises:

a signal generation circuit, comprising a plurality of signal output terminals, configured to output driving signals through the plurality of signal output terminals respectively;

a first operational amplification circuit, comprising a plurality of input terminals and a plurality of output terminals in one-to-one correspondence with the input terminals, configured to level-convert a voltage of an input terminal and output the voltage through an output terminal corresponding to the input terminal, and the signal output terminals of the signal generation circuit being arranged in one-to-one correspondence with the input terminals of the first operational amplification circuit;

a plurality of switching circuits, the switching circuit being connected between the signal output terminal of the signal generation circuit and the input terminal of the first operational amplification circuit that are in one-to-one correspondence, connected to a control signal terminal, and configured to communicate the signal output terminal of the signal generation circuit with the input terminal of the first operational amplification circuit in response to a signal of the control signal terminal;

wherein at least part of the switching circuits are connected to different control signal terminals.

16. The display panel according to claim 15, the level conversion circuit further comprises:

a register configured to store a control signal set;

a control circuit connected to the register and the control signal terminals, configured to input corresponding control signals to the plurality of control signal terminals according to the control signal set.

17. The display panel according to claim 16, wherein the register is connected to a control signal generation circuit for configuring the control signal set to the register.

18. The display panel according to claim 17, wherein the level conversion circuit is applied to a display panel, the display panel further comprises a timing controller shared by the control signal generation circuit.

19. The display panel according to claim 16, wherein the switching circuit is configured to communicate the signal output terminal of the signal generation circuit with the input terminal of the first operational amplification circuit in response to a high-level signal;

the control signal set comprises a first control signal and a second control signal, the plurality of control signal terminals comprise a first control signal terminal, a second control signal terminal, a third control signal terminal, and a fourth control signal terminal, the control circuit comprises:

a first AND gate provided with a first input terminal and a second input terminal connected to a high-level signal terminal and an output terminal connected to the first control signal terminal;

an OR gate provided with a first input terminal receiving the first control signal, a second output terminal receiving the second control signal, and an output terminal connected to the second control signal terminal;

a second AND gate provided with a first input terminal receiving the first control signal, a second input terminal receiving the first control signal, and an output terminal connected to the third control signal terminal;

a third AND gate provided with a first input terminal receiving the first control signal, a second input terminal receiving the second control signal, and an output terminal connected to the fourth control signal terminal.

20. The display panel according to claim 15, wherein at least one of the control signal terminals is connected to the plurality of switching circuits.

* * * * *